United States Patent [19]

Asawa et al.

[11] Patent Number: 4,537,673

[45] Date of Patent: Aug. 27, 1985

[54] ELECTROLYTIC CELL

[75] Inventors: Tatsuro Asawa; Yasuo Sajima; Junjiro Iwamoto, all of Yokohama, Japan

[73] Assignee: Asahi Glass Company Ltd., Tokyo

[21] Appl. No.: 397,177

[22] Filed: Jul. 12, 1982

[30] Foreign Application Priority Data

Jul. 14, 1981 [JP] Japan ..... 56-108840
Jul. 14, 1981 [JP] Japan ..... 56-108841
Jul. 21, 1981 [JP] Japan ..... 56-112973

[51] Int. Cl.[3] ..... C25B 13/02

[52] U.S. Cl. ..... 204/253; 204/98; 204/296

[58] Field of Search ..... 204/98, 252, 258, 263, 204/266, 296

[56] References Cited

U.S. PATENT DOCUMENTS 3,923,630 12/1975 Argade et al. .
4,191,627 3/1980 Specht ..... 204/296
4,218,275 8/1980 Kadija et al. .
4,229,277 10/1980 Specht ..... 204/296
4,263,121 4/1981 Christensen ..... 204/296
4,278,529 7/1981 Kadija ..... 204/296
4,329,217 5/1982 Byrd et al. ..... 204/296

FOREIGN PATENT DOCUMENTS 0066102 12/1982 European Pat. Off. ..... 204/296

*Primary Examiner*—Howard S. Williams
*Assistant Examiner*—Terryence Chapman
*Attorney, Agent, or Firm*—Oblon, Fisher, Spivak, McClelland & Maier

[57] ABSTRACT

An electrolytic cell comprises intercalated finger-shaped electrodes each disposed through a cation exchange membrane, in which said cation exchange membrane constitutes a cylinder or envelope enclosing a finger-shaped anode or cathode A flare is formed at one end or each end of the cylinder or at the open end of the envelope. The flare is joined with a flange to form a unitary cation exchange membrane-flange structure which liquid-tightly divides an anode compartment and a cathode compartment.

9 Claims, 6 Drawing Figures

ELECTROLYTIC CELL

BACKGROUND OF THE INVENTION

1. Field of the Invention

The present invention relates to an electrolytic cell and more particularly to a finger-type ion exchange membrane electrolytic cell.

2. Description of the Prior Art

As a process for producing an alkali metal hydroxide by the electrolysis of an aqueous solution of an alkali metal chloride, the diaphragm method has been mainly employed instead of a conventional mercury method with a view to the prevention of an environmental pollution.

In the diaphragm method, a diaphragm made of e.g. asbestos is commonly industrially used. As an electrolytic cell in which such an asbestos diaphragm is used, a so-called Diamond Shamrock cell or Hooker cell is practically used which is a monopolar cell in which a number of anode fingers upstanding from the bottom of the cell are secured by bolts and a container provided with a number of cathode fingers deposited on their surfaces with asbestos, is placed to insert the cathode fingers between the above anode fingers, respectively.

As another example of such an electrolytic cell, a so-called Glanor cell is known which is a bipolar cell in which two pairs of finger-shaped electrodes each formed by folding back an electrode plate along its center line to have tapered side walls, are assembled so that the anode fingers and the cathode fingers are mutually intercalated, and asbestos is deposited on the cathode fingers in the form of a diaphragm.

However, the alkali metal hydroxide obtainable by these asbestos methods has a low concentration and contains an alkali metalk chloride as an impurity, and its industrial applications are limited, for instance, it can not be used directly as an industrial reagent.

Whereas, as a means to directly obtain an alkali metal hydroxide of a high concentration with a high purity by electrolysis. various proposals have been made in which an ion exchange membrane is used instead of the asbestos diaphragm. In case one already owns an asbestos electrolytic cell as described above, it is unnecessary to install a new electrolytic cell if an ion exchange membrane can be substituted for the asbestos of the asbestos electrolytic cell, and by such a substitution, it will be possible to obtain an alkali metal hydroxide of a high concentration with a high purity.

SUMMARY OF THE INVENTION

An extensive research has been conducted with an aim to develop an effective means for substituting an ion exchange membrane for the asbestos in the monoplanar or bipolar cell as mentioned above, and as a result, the present invention has been accomplished.

The present invention provides an electrolytic cell comprising intercalated finger-shaped electrodes each disposed through a cation exchange membrane in which said cation exchange membrane constitutes a cylinder or envelope enclosing a finger-shaped anode or cathode. A flare is formed at one end of each end of the cylinder or at the open end of the envelope. The flare is joined with a flange to form af unitary cation exchange membrane-flange structure which liquid-tightly divides an anode compartment and a cathode compartment.

DETAILED DESCRIPTION OF THE PREFERRED EMBODIMENTS

Figure 2:
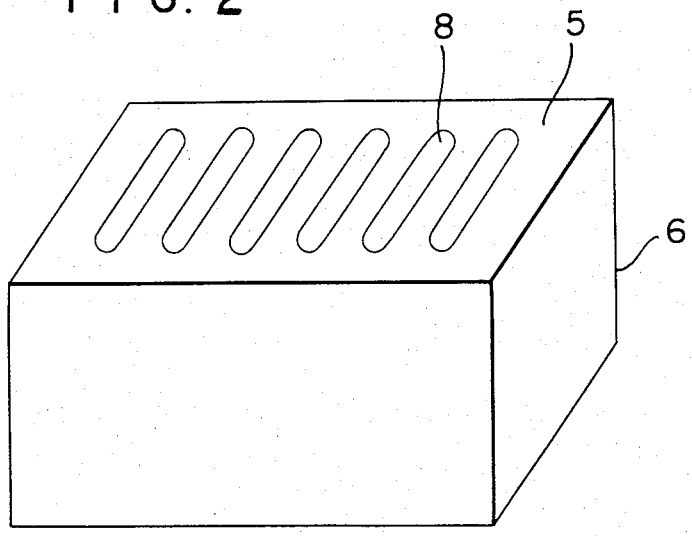
FIG. 2 is a perspective view of a cathode box with a cell top cover removed.

As the ion-exchange membrane to be used in the present invention, those which comprise a polymer containing cation-exchange groups such as carboxyl groups, sulfonic acid groups, phosphoric acid groups, phenolic hydroxy groups, etc. are used. As such a polymer, fluorine-containing polymers are particularly preferable. As the fluorine-containing polymers having ion-exchange groups, there are suitably used copolymers of vinyl monomer (e.g. tetrafluoroethylene, chlorotrifluoroethylene, or the like), perfluorovinyl monomer containing a reactive group capable of being converted to an ion-exchange group such as sulfonic acid, carboxylic acid, phosphoric acid, or the like, and perfluorovinyl monomer containing an ion-exchange group such as sulfonic acid, carboxylic acid or phosphoric acid.

In addition, there can be used those which comprise a trifluorostyrene membranous polymer having introduced thereinto ion-exchange groups such as sulfonic acid groups and those which are prepared by introducing sulfonic acid groups into a styrene-divinylbenzene copolymer.

Of these, polymers prepared by using monomers capable of forming the following polymerization units (i) and (ii) are particularly preferable because they enable to obtain caustic alkali with high purity and considerably high current efficiency:

$$\text{(i)}\ -(CF_2-CXX')- \qquad \text{(ii)}\ -(CF_2-\underset{\underset{Y}{|}}{C}-X)-$$

wherein X represents a fluorine atom, a chlorine atom, a hydrogen atom or $-CF_3$, X' represents X or $CF_3(CF_2)_m-$(wherein m represents 1 to 5), and Y is selected from those of the formulae:

$$-P-A \text{ and } -O-(CF_2)_m-(P, Q, R)-A$$

(wherein P represents $-(CF_2)_a-(CXX')_b-(CF_2)_c$, Q represents $-(CF_2-O-CXX')_d-$, R represents $-(CXX'-O-CF_2)_e-$, (P, Q, R) represents that at least one P, one Q and one R are aligned in an arbitrary order, X and X' are the same as defined above, n=0 to 1, a, b, c, d, and e each represents —COOH or a functional group capable of being converted to —COOH by hydrolysis or neutralization [e.g. —CN, —COF, $-COOR_1$, —COOM, $-CONR_2R_3$, etc. (wherein $R_1$ represents an alkyl group containing 1 to 10 carbon atoms, M represents an alkali metal or a quaternary ammonium group, and $R_2$ and $R_3$ each represents a hydrogen atom or alkyl group containing 1 to 10 carbon atoms)].

As the preferable examples of Y described above, there are illustrated, for example, the following ones wherein A is bound to a fluorine-containing carbon atoms;

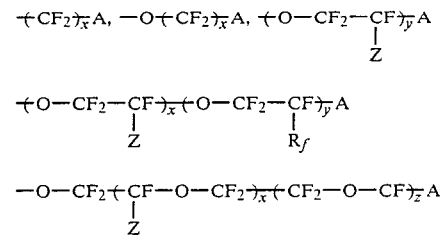

wherein x, y, and e each represents 1 to 10, Z and $R_f$ each represents —F or a perfluoroalkyl group containing 1 to 10 carbon atoms, and A is the same as defined above.

Where a fluorine-containing cation-exchange membrane comprising such copolymer and having the intramembranous carboxylic acid group density of 0.5 to 2.0 meq per g of the dry resin is used, a current efficiency as high as 90% or more can be attained even when concentration of caustic soda becomes 40% or more. Intramembranous carboxylic acid density of 1.1 to 1.8 meq per g of the dry resin is particularly preferable because such density assures to obtain caustic soda with as high a concentration as described above and with high current efficiency over a long period of time. For attaining the above-described ion-exchange capacity, the copolymers comprising the above-described polymerization units (i) and (ii) preferably contains 1 to 40 mol %, particularly preferably 3 to 25 mol %, of (ii).

Preferable ion-exchange membranes to be used in the present invention are constituted by a non-crosslinkable copolymer obtained by the copolymerization of a fluorine-containing olefin monomer as described above with a polymerizable monomer having a carboxylic acid group or a functional group capable of being converted to a carboxylic acid group. The molecular weight of the copolymer ranges preferably from about 100,000 to 2,000,000, particularly preferably from 150,000 to 1,000,000. In preparing such a copolymer, one or more monomers per each monomer unit are used, a third monomer optionally being copolymerized to modify the membrane. For example, the combined use of $CF_2{=}CFOR_f$(wherein $R_f$represents a perfluoroalkyl group containing 1 to 10 carbon atoms) can impart flexibility to a resulting membrane, and the combined use of divinyl monomer such as $CF_2CF{=}CF{=}CF_2$ or $CF_2{=}CFO(CF_2)_{1\text{-}3}CF{=}CF_2$ can crosslink the copolymer to thereby impart mechanical strength to the membrane.

Copolymerization between the fluorinated olefin monomer, the polymerization monomer having a carboxylic acid group or a functional group capable of being converted to carboxylic acid group and, if necessary, the third monomer can be conducted in any conventionally known process. That is, the copolymerization can be conducted by catalytic polymerization, thermal polymerization, radiation polymerization, etc. using, if necessary, a solvent such as halogenated hydrocarbon. Processes to be employed for filming the thus obtained copolymer into an ion-exchange membrane are not particularly limited, and known ones such as press-molding, roll-molding, extrusion molding, solution casting, dispersion molding, powder molding, etc. may properly be employed.

The thickness of the thus obtained membrane is suitably controlled to 20 to 500$\mu$ particularly preferably 50 to 400$\mu$.

Where the copolymer contain functional groups capable of being converted to carboxylic acid groups and does not contain carboxylic acid groups, the functional groups are converted to carboxylic acid groups by a proper corresponding treatment before or after, preferably after, the filming step. For example, where the functional groups are —CN, —COF, —$COOR_1$ —COOM, or —$CONR_2R_3$ (wherein M and $R_1$–$R_3$ are the same as defined herein-before), they are converted to carboxylic acid groups by hydrolysis or neutralization using an acid or alkali alcohol solution, and, when the functional groups are double bonds, they are reacted with —$COF_2$ to convert to carboxylic acid groups.

Further, the cation-exchange membrane to be used in the present invention may, if necessary, be mixed with an olefin polymer such as polyethylene or polypropylene, preferably fluorine-containing polymer such as polytetrafluoroethylene or ethylene-tetrafluoroethylene copolymer before being molded. It is also possible to reinforce the membrane by using texture (e.g. cloth, net, etc.), non-woven fabric, porous film or the like comprising these copolymers, or metallic wire, net, or porous body as a support.

Further, in order to minimize the cell voltage, it is preferred that the cation exchange membrane is integrally provided at least on one side thereof with a gas and liquid permeable non-electrocatalytic porous layer having a thickness less than that of the cation exchange membrane. (Japanese Unexamined Patent Publication No. 75583/1981)

The gas and liquid permeable porous layer is preferably formed by bonding particles on the surface of the cation exchange membrane. The amount of the particles deposited to form the porous layer may vary depending upon the nature and size of the particles. However, it is preferably from 0.005 to 50 mg, especially from 0.01 to 30 mg per $cm^2$ of the membrane surface. If the amount is too small, no desired effect can be expected, and if the amount is too large, the electric resistance of the membrane increases.

The particles to form the gas and liquid permeable porous layer on the surface of the cation exchange membrane may be made of electroconductive or non-conductive inorganic or organic material so long as they do not function as an electrode. However, they are preferably made of a material which is resistant to corrosion in the electrolytic solution. As typical examples, there may be mentioned a metal or a metal oxide, hydroxide, carbide or nitride or a mixture thereof, carbon or an organic polymer.

As preferred specific material for the porous layer on the anode side, there may be used a single substance of Group IV-A of the Periodic Table (preferably, silicon, germanium, tin or lead), Group IV-B (preferably, titanium, zirconium or hafnium), Group V-B (preferably, niobium or tantalum), an iron group metal (iron, cobolt or nickel), chromium, manganese or boron, or its alloy, oxide, hydroxide, nitride or carbide.

On the other hand, for the porous layer on the cathode side, there may advantageously be used, in addition to the materials useful for the formation of the porous layer on the anode side, silver, zirconium or its alloy, stainless steel, carbon (activated carbon or graphite), or silicon carbide, as well as polyamide resin, a polysulfone resin, a polyphenyleneoxide resin, a polyphenylenesulfide resin, a polypropylene resin or a polyimide resin.

For the information of the porous layer, the above mentioned particles are used preferably in a form of powder having a particle size of from 0.01 to 300μ especially from 0.1 to 100μ. If necessary, there may be incorporated a binder of e.g. a fluorocarbon polymer such as polytetrafluoroethylene or polyhexafluoroethylene, or a viscosity-increasing agent, for instance, a cellulose material such as carboxymethyl cellulose, methyl cellulose or hydroxyethyl cellulose, or a water soluble substance such as polyethylene glycol, polyvinyl alcohol, polyvinyl pyrrolidone, sodium polyacrylate, polymethylvinyl ether, casein or polyacrylamide. The binder or the viscosity-controlling agent is used in an amount of preferably from 0 to 50% by weight, especially from 0.5 to 30% by weight.

Further, if necessary, there may further be added a suitable surfactant such as a long chained hydrocarbon or a fluorohydrocarbon, or graphite or other electroconductive fillers to facilitate the bonding of the particles to the membrane surface.

To bond the particles or particle groups to the surface of the ion exchange membrane, a binder and a viscosity-increasing agent which are used as the case requires, are adequately mixed in a suitable solvent such as an alcohol, a ketone, an ether or a hydrocarbon to obtain a paste, which is then applied to the membrane surface by transfer or screen printing. Alternatively, it is possible to deposit the particles or particle groups on the membrane surface by forming a syrup or slurry of a mixture of the particles instead of the paste of the mixture, and spraying the syrup and slurry onto the membrane surface.

The porous layer-forming particles or particle groups are then preferably pressed under heating by means of a press or rolls preferably at a temperature of from 80° to 220° C. under pressure of 1 to 150 kg/cm$^2$. It is preferred that they are partially embedded in the membrane surface.

The porous layer thus formed by the particles or particle groups bonded to the membrane surface preferably has a porosity of at least 10%, especially at least 30%, and a thickness of from 0.01 to 200μ, especially from 0.1 to 100μ, more especially from 0.5 to 50μ.

The porous layer may be formed on the membrane surface in a form of a densed layer where a great amount of the particles is bonded to the membrane surface or in a form of a single layer wherein the particles or particle groups are bonded to the membrane surface independently without being in contact with one another. In the latter case, it is possible to substantially reduce the amount of the particles to form the porous layer, and in certain cases, the formation of the porous layer can be simplified.

Further, the porous layer according to the present invention may be formed by bonding a preliminarily formed porous layer having the above mentioned properties to the membrane surface instead of bonding the particles directly to the membrane surface as mentioned above. As the material to form such a porous layer, there may be used a woven or non-woven fabric made of the above mentioned materials.

Now, a specific process for preparing the electrolytic cell of the present invention will be described.

The opposing side edges of a rectangular sheet of the above mentioned cation exchange membrane are joined to form a cylinder. In a case where this cylindrical membrane is applied to the Diamond Shamrock cell or the Hooker cell, each open end of the cylinder is pressed under heating to form a flare. When it is applied to the Glanor cell, only one of the two open ends of the cylinder is formed into a flare in the same manner as above, and the other end is closed by e.g. heat-sealing, whereby an envelope having a flare at the open end is obtained.

This flare may be formed in a specific manner as described hereinafter. The width of the flare should not be too great, and is usually from 10 to 15 mm. In order to mount the formed membrane on the electrolytic cell, it is necessary to attach a flange having a greater width to this flare. This flange may be made of any material so long as it is capable of being readily joined to the cation exchange membrane by heat sealing. It may not necessarily have an ion exchange capacity. It is usually a rectangular sheet made of a fluorine-containing polymer and having at its center an opening of the same or a little larger shape as the open end of the cylinder or envelope of the membrane. This flange sheet may have a plurality of openings corresponding to the locations of the electodes, so that the corresponding number of the cylinders or envelopes can be attached thereto with their flares joined with the edges of the openings by heat sealing.

The flanged cylinders or envelopes of the cation exchange membrane thus obtained will then be mounted on the electrolytic cell in the following manner. The description will be made with respect to the Diamond Shamrock cell and the Glanor cell as typical examples.

Figure 1:
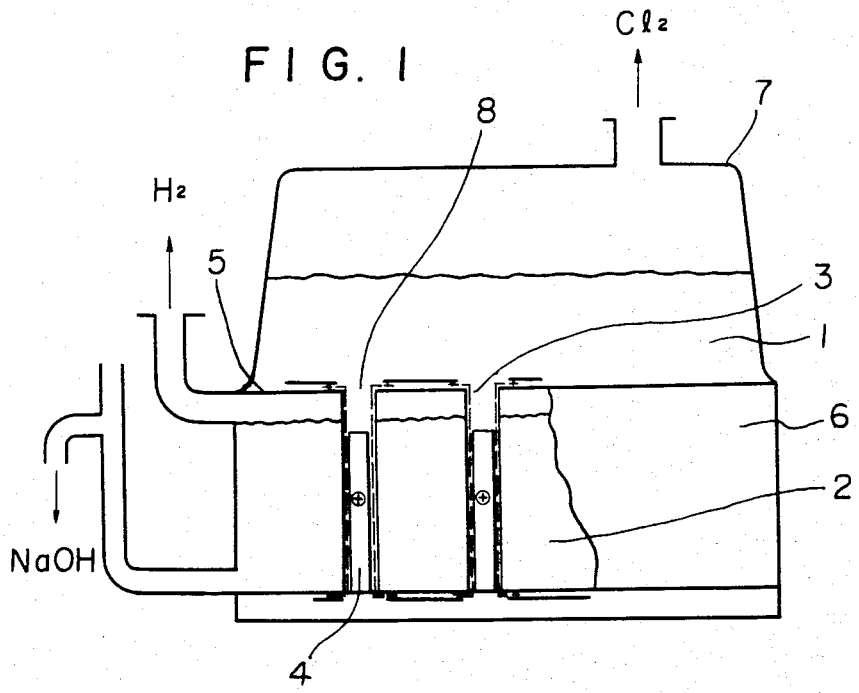
FIG. 1 is a partly cross sectional view of a typical Diamond Shamrock cell.

FIG. 1 is a partly cross sectional view of the typical Diamond Shamrock cell. Reference numeral 1 designates an anolyte and numeral 2 designates a catholyte. A cylindrical cation exchange membrane is shown at numeral 3 by a dotted line. The cylinder 3 encloses an anode 4. Reference numeral 5 designates a separator plate which separates the anolyte 1 in the anode compartment from the catholyte 2 in the cathode compartment. Reference numeral 6 designates a cathode box, and numeral 7 designates a cell top cover.

FIG. 2 is a perspective view of the cathode box 6 with the cell top cover 7 removed. Reference 8 designates an opening through which an anode is to be inserted.

Figure 3:
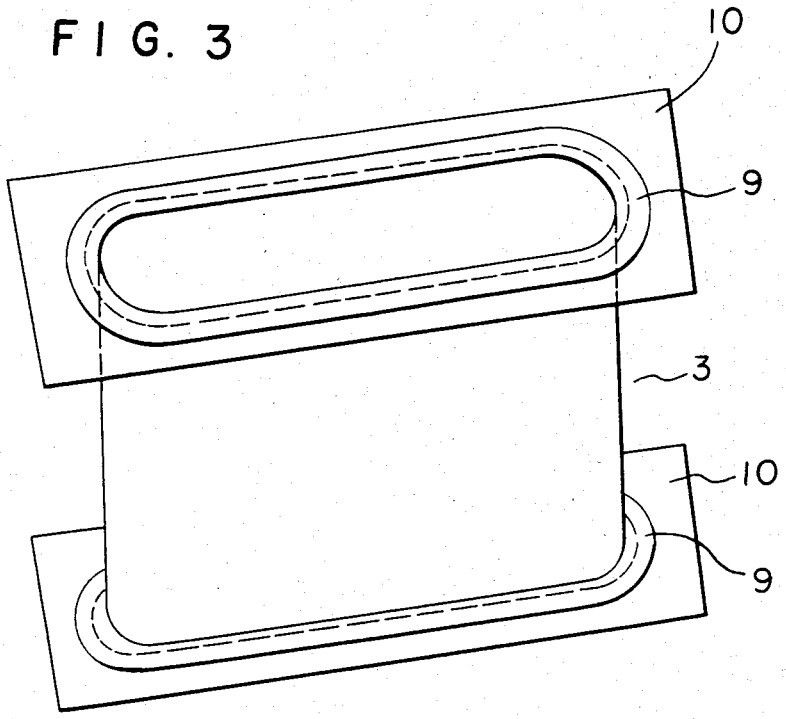
FIG. 3 is a cylinder of a cation exchange membrane to be used for the electrolytic cell of the present invention.

FIG. 3 is a cylinder 3 of the cation exchange membrane to be mounted on the electrolytic cell of the present invention. A flare 9 is formed at each of the upper and lower ends of the cyliner, and a flange 10 is heat-sealed in this flare 9.

In the case of the Diamond Shamrock cell, the cylinder 3 thus prepared and provided at both ends with flanges 10, is placed in the opening 8 of the cathode box for receiving an anode so that the upper flange overlies the upper plate i.e. the separator plate 5 of the cathode box and the lower flange underlies the bottom plate of the cathode box. The inside of the cylindrical membrane constitutes an anode compartment to accomodate an anode. The upper flange and the lower flange are respectively joined with the corresponding upper and lower flanges of the adjacent cylindrical membrane to form an integral assembly.

Figure 4:
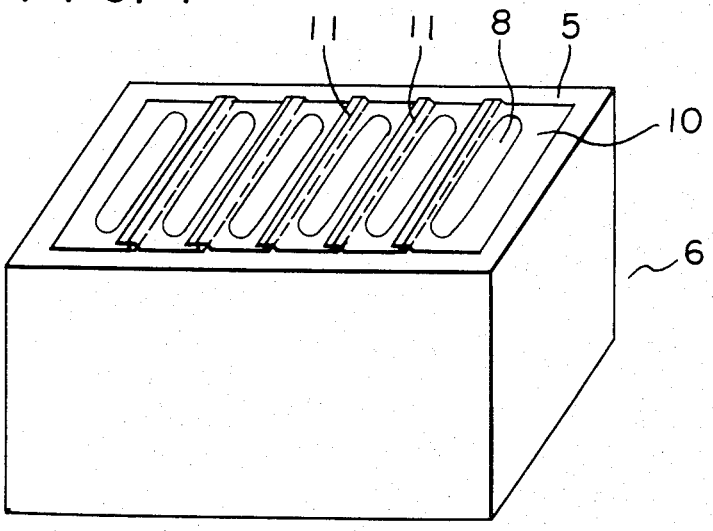
FIG. 4 is a perspective view of the cathode box illustrating liquid-tight joining of flanges.

FIG. 4 is a perspective view of the cathode box illustrating the manner in which the upper flanges are liquid-tightly joined with one another. The lower flanges (not shown) are likewise liquid-tightly joined with one another.

In FIG. 4, the joint portions of the flanges are exaggerated and the joint portions between the flares and the flanges are omitted to simplify the illustration. Reference numeral 11 designates the heat sealing line where the flanges are linearly joined by heat sealing.

Thus, the cathode box provided with the cation exchange membranes is obtained, and a Diamond Shamrock cell is constructed by inserting anodes into the cylinders of the cation exchange membranes and placing a cover on the cathode box.

In the case where the cation exchange membranes are to be mounted on the Glanor cell, an envelope provided only at one end thereof with a flange is used. In mounting the formed membranes on the Glanor cell, the envelopes are put on finger-shaped cathodes and the flanges of the envelopes are liquid-tightly joined with one another, and the outer side flanges are joined to the flanges of the electrolytic cell. In the case of the Glanor cell, as an alternative method, the flanges of the envelopes are preliminarily joined one another so that the envelopes are spaced from one another for a distance corresponding to the distance between the finger-shaped cathodes of the Glanor cell. This method is practically more efficient than the above mentioned method.

Now, the process for preparing the flange cylinder or envelope of the cation exchange membrane will be described specifically.

Firstly, the process for preparing a cylinder from a cation exchange membrane sheet will be described.

For the preparation of the cylinder from the membrane sheet, it is naturally conceivable to bend the membrane sheet so that the opposing side edges overlaps each other. However, in such a case, the overlapping portion i.e. the joint will have a thickness twice the thickness of the membrane sheet, and the cylinder thereby obtainable will have a locally swelled portion along the joint portion.

In order to avoid the above disadvantage, it is preferred that a rectangular cation exchange membrane is bent to form a generally cylindrical shape with a small space left between the opposing side edges thereof and a thin resin film is placed to cover the space, and then the resin film is heat-sealed against the side edges to form a cylinder.

The thin resin film to be heat sealed on the opposing side edges of the ion exchange membrane may be made of any material, but preferably it is made of a material similar to the ion exchange membrane to be joined. More preferably, it is made to a material having substantially the same physical properties as the ion exchange membrane to be joined and a slightly lower softening point, i.e. a softening point lower by from 5° to 10° C. than the softening point of the ion exchange membrane.

Now, the manner for pressing and heating i.e. heat sealing, will be described.

The opposing side edges of the cation exchange membrane to be joined are placed on a flat plate with a substantially equal space of not more than 2 mm. Then, a thin resin film is placed thereon to cover the space. The width of the film is preferably from 10 to 15 mm, although it is dependent on the width of the space, the thickness of the cation exchange membrane and the thickness of the film.

When heated, the film will partially melts and flows to the space. However, the film does not completely melt to fill the space. Accordingly, the film should preferably have a thickness such that the film remaining on the cation exchange membrane will not substantially add to the thickness of the edge portions of the membrane when heat sealed, namely a thickness of from 3/5 to 1/10 of the thickness of the cation exchange membrane. When pressed under heating, the film undergoes a thermal deformation and will be thinned, and if the film thickness is within the above range, it does not substantially add to the thickness of the edge portions of the membrane when heat sealed.

The volume of the film is, of cource, required to be greater than the volume of the space defined by the opposing side edges of the cation exchange membrane. However, the volume should not be so great that an excessive amount of the film will remain on the ion exchange membrane. The film should preferably have a volume of from 1.0 to 10 times the volume of the space.

After placing the film on the opposing side edges of the membrane, a pressing plate equipped with a heater is pressed thereon. This pressing plate is preferably a bakelite plate equipped internally with a nichrome wire heater. The width of the nichrome wire heater is preferably at least twice the width of the space between the opposing side edges of the cation exchange membrane and at least $\frac{2}{3}$ time the width of the film. If the width of the heater is less than twice the width of the space, the fusion of the joint edges of the cation exchange membrane will be inadequate and the adhesion with the fused film tends to be insufficient. Further, if the width of the heater is less than $\frac{2}{3}$ time the width of the film, the outer edge portions of the film will not undergo a thermal deformation and will remain without being thinned.

The actual heating and pressing conditions are optionally selected depending upon the physical properties and thicknesses of the cation exchange membrane and the resin film. For instance, in a case where both the cation exchange membrane and the resin film are made of a perfluorohydrocarbon such as a copolymer of tetrafluoroethylene and $CF_2{=}CFO(CF_2)_3COOCH_3$, the pressure may be about 1 kg/cm$^2$, the temperature may be from 240° to 260° C. and the time may be about 5 minutes.

Now, the manner for forming a flare at the opening end of this cylinder will be described.

Figure 5:
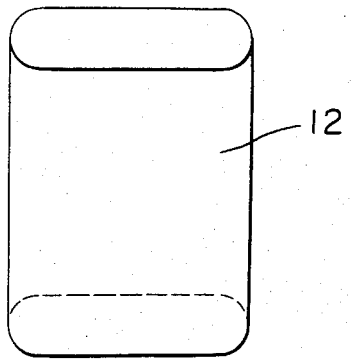
FIG. 5 is a perspective view of a cylindrical ion exchange membrane prior to the formation of a flare.

FIG. 5 is a perspective view of the cylindrical ion exchange membrane prior to the formation of a flare.

Figure 6:
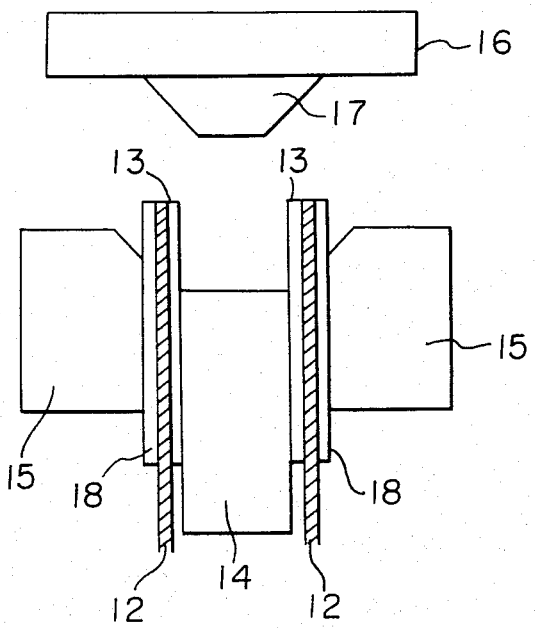
FIG. 6 is a cross sectional diagrammatic view of an apparatus for forming the flare, in which the cylindrical ion exchange membrane is set for the flare forming operation.

FIG. 6 is a cross sectional diagrammatic view of an apparatus for forming the flare, in which cylindrical ion exchange membrane is set for the flare forming operation.

The cylindrical ion exchange membrane 12 as shown in FIG. 5 can be prepared by joining the opposing side edges of a cation exchange membrane sheet in the above mentioned manner to form a cylinder.

Referring to FIG. 6, reference numeral 12 is a cylindrical ion exchange membrane, and numeral 13 is a deformable cylindrical body having a greater rigidity than the ion exchange membrane. Reference numeral 14 is an inner support, numeral 15 is an outer die and numeral 16 is an upper die. The upper die 16 is provided on its lower surface with a tapered press die 17 equipped internally with a heating means. Reference numeral 18 designates a cylindrical body provided outside the cylindrical ion exchange membrane and having the same properties as the cylindrical body 13.

In FIG. 6, the press die 17 is heated to a temperature at which the ion exchange membrane is softened and deformable, and as the press die is advanced into the inside of the cylindrical ion exchange membrane, the open end portion of the cylindrical ion exchange membrane will be gradually softened and stretched outwardly by the tapered surface of the press die, and the stretched portion will finally form a flare.

In the case, it is necessary that a deforamble cylindrical body having a greater rigidity than the ion exchange membrane is placed against at least the inner surface of the ion exchange membrane.

The ion exchange membrane commonly used, usually has a thickness of several hundreds microns and is not self-supporting. At the time of the above mentioned operation, the open end portion of the ion exchange membrane is likely to undergo an excessive deformation i.e. it is likely to be stretched too much due to the high temperature at the inner surface of the ion exchange membrane, whereupon the flare tends to be wrapped or corrugated.

In order to avoid such an excessive deformation, it is preferred to place against the outer surface of the cylindrical ion exchange membrane a cylindrical body which is deformable but has a greater rigidity than the ion exchange membrane.

The material for this cylindrical body is not critical so long as it is deformable and has a greater rigidity than the ion exchange membrane as mentioned above. However, it is preferred that the cylindrical body is made of a material which can readily be released from the press die and which hardly adheres to the ion exchange membrane. In this respect, the present inventors have made a study on materials having such properties and as a result, have found that a glass woven fabric fiber (i.e. glass cloth) impregnated with polytetrafluoroethylene is most suitable as a material having all of the above mentioned desired properties.

Further, it is preferred that such a cylindrical body is placed against the outer surface of the cylindrical ion exchange membrane as well as the one placed against the inner surface of the membrane. The cylindrical body placed against the inner surface of the membrane serves also as a releasing agent against the inner support.

With respect to the inner and outer cylindrical bodies, the inner cylindrical body should preferably be thicker than the outer cylindrical body, because the inner cylindrical body serves to convert the descending force of the press die to the outwardly stretching force and thus is required to have a greater rigidity than the outer cylindrical body.

The greater the width of the flare is made, the thinner the outer edge portion of the flare becomes. Therefore, the stretching should be limited so as to bring the width to be about from 10 to 20 mm.

No special means is required for closing the other open end of the membrane to form an envelope, i.e. the envelope may be formed simply by closing and heat sealing the open end.

Now, the manner for attaching a flange to the cylinder or the envelope will be described.

As mentioned above, the material for the flange may not necessarily have the same ion exchange capacity as the cation exchange membrane, and may be a usual resin, preferably a fluorine-containing resin.

The flange is provided with an opening having the same size as the size of the open end of the cylinder or the envelope or a slightly larger size than the size of the open end. After mounted on the electrolytic cell, the flanges are joined with one another to form an integral assembly. The flanges may prelimarily be joined with one another before the mounting. Alternatively, the flange is made of a large sheet provided with a plurality of openings corresponding to the number of the cylinders or envelopes to be attached thereto.

However, in the case of the Diamond Sharmock cell, such a large flange or preliminarily joined-flanges are applicable only to one of the upper and lower flanges, and the flanges on the other side will have to be joined with one another after mounting them on the electrolytic cell.

For liquid-tighting joining of the flanges with one another, it is unnecessary to heat seal the entire overlapping portions of the flanges, and the heat sealing in a linear line suffices. As a means to effect the heat sealing in a linear line, it is preferred to use a press plate equipped internally with a heater. For instance, a nichrome wire strip is placed on the press plate, and the overlapping films of the flanges are pressed against the press plate under heating to obtain a liquid-tight joint.

Now, preferred embodiments of the present invention will be described with reference to Examples.

EXAMPLE 1

In substitution for asbestos diaphragms in an asbestos diaphragm electrolytic cell DS-45 Model manufactured by Diamond Shamrock Co., cation exchange membranes composed of a copolymer of polytetrafluoroethylene and $CF_2{=}CFO(CF_2)_3COOCH_3$ and having an ion exchange capacity of 1.45 meq/g dry resin and a thickness of 280$\mu$, were mounted on the electrolytic cell in the following manner.

A cation exchange membrane having the above physical properties, a thickness of 280$\mu$ and a size of 81 by 182 cm, was bent so that the side edges having a length of 81 cm faced each other with a space of about 1 mm on a lower die covered with glass fibre impregnated with PTFE-silicon rubber.

Then, a cation exchange membrane (1 cm$\times$81 cm$\times$150$\mu$) composed of a copolymer of tetrafluoroethylene and $CF_2{=}CFO(CF_2)_3COOCH_3$ was placed to cover the space.

A heating plate made of bakelite and equipped internally with a heater having a nichrome wire width of 10 mm and heated by the heater to bring the temperature of the lower surface of the heating plate (i.e. the surface to be brought in contact with the cation exchange membrane) to 240° C., was pressed thereon under pressure of 1 kg/cm$^2$ for 5 minutes with the center line of the heater being in alignment with the center line of the space, whereupon a cylinder having a size of 6 cm in width, 89 cm in length and 81 cm in height to receive a finger-shaped anode and with its both ends open, was formed.

Then, with use of the apparatus as shown in FIG. 6, the cylinder was set in the flare-forming die by placing a glass fiber fabric impregnated with polytetrafluoroethylene and having a thickness of 350$\mu$ against the inner surface of the cylinder and placing the same glass fiber fabric having a thickness of 250$\mu$ against the outer surface of the cylinder. The flare-forming die comprised an inner support having a cross section of about 6×89 cm, and an outer die. A tapered press die having a lower surface of about 6×90 cm, a top surface of about 4×87 cm and a height of 2.5 cm was disposed thereabove. This press die was internally equipped with a heating means.

The press die was heated to 200° C. and inserted into the open end of the cylindrical cation exchange membrane to press and stretch the membrane to form a flare. The width of the flare was 12 mm. A flare was formed also at the other open end of the cylindrical membrane in a similar manner.

Then, at the center portion of a film (950×110 cm, 280μ in thickness) made of the same cation exchange as mentioned above, an opening of about 6×89 cm was provided, and this membrane film was placed on the flare of the cylindrical cation exchange membrane and heat sealed there along the track-shaped flare.

The heat sealing was carried out with use of a press plate made of a bakelite sheet of 12.0×97.0 cm provided with a track groove of about 8×91 cm having a depth of 4.5 cm and the width of 3.5 mm. A sheathed nichrome wire heater was embedded in the groove. The flare portion of the membrane and the flange of the film were placed in an overlapping manner on the groove, and the groove portion was heated to about 230° C. to effect the heat sealing along the line of the groove.

The flanged cation exchange membrane cylinders thus obtained in the above described manner were set in the openings of the cathode box of the Diamond Shamrock cell (DS-45 Model) and their flanges were heat sealed to one another. After placing anodes in the cylinders, a cover made of FRP for holding a brine was placed to obtain a complete assembly of an electrolytic cell.

An aqueous solution containing 25% by weight of sodium hydroxide and an aqueous solution containing 300 g/l of NaCl were introduced into the cathode compartment and the anode compartment, respectively, of this electrolytic cell, and the respective solutions were heated to 90° C. Then, in the anode compartment, 10% by weight of HCl was added at a rate of 0.6 l/hr to the aqueous solution of 300 g/l of sodium chloride held at 90° C. and the aqueous sodium chloride solution was introduced at a rate of 850 l/hr, whereby the membranes were hydrolyzed for 16 hours. Upon completion of the hydrolysis of the membranes, the addition of HCl to the sodium chloride solution was stopped, and electrolysis was conducted by supplying an electric current of 60 KA while introducing water at a rate of 85 l/hr. When the system reached a steady state at a NaOH concentration in the cathode compartment of 35% by weight, the cell voltage was 3.55 V, the purity of $Cl_2$ was 97.2% and the NaCl concentration in the catholyte was 17 ppm as calculated based on the NaOH concentration of 50% by weight.

EXAMPLE 2

Cation exchange membranes made of the same material as in Example 1 were mounted on an experimental Glanor cell comprising fingers having a finger length of 200 mm, a height of 600 mm and a finger root width of 27 mm, in the following manner.

The same cation exchange membrane sheet as in Example 1 was formed with a cylinder in the same manner as in Example 1 so that the open ends had a size of 27×600 mm. The height of the cylinder was 240 mm which was longer than the length of each finger to ensure that a sufficient width for the flare was available and one end of the cylinder could be heat sealed.

Then, in the same manner as in Example 1, a flare having a width of 12 mm was formed at one end of the cylinder, and the other end was closed and heat sealed, whereupon an envelope having a flare was obtained. Then, in the same manner as in Example 1, a flange was heat sealed to the flare. A plurality of such envelopes were then joined by heat sealing the respective flanges to one another with a proper distance corresponding to the locations of the cathode fingers of the experimental Glanor cell. Thus, an integral cation exchange membrane assembly provided with a plurality of envelopes was obtained.

Then, the membrane assembly was put on the cathodes of the experimental Glanor cell, and the outer periphery of the membrane assembly was secured to a flange of the electrolytic cell. Anode fingers were then intercalatively inserted between the cathode fingers to obtain a complete assembly of the experimental Glanor cell.

This cell was operated under the same conditions as in Example 1, whereupon the following results were obtained.

NaOH concentration in the cathode compartment: 35% by weight
Cell voltage: 3.51 V
$Cl_2$ concentration: 97.5%
NaCl concentration in the aqueous NaOH solution: 18 ppm

EXAMPLE 3

The experiment was conducted in the same manner as in Example 1 except that the following cation exchange membrane provided on its surface with a porous layer was used for the cylinder.

Namely, to 10 parts of an aqueous solution containing 2% by weight of methyl cellulose as a viscosity-controlling agent, 2.5 parts of an aqueous dispersion containing 7.0% by weight of polytetrafluoroethylene (hereinafter referred to as "PTFE") having a particle size of not more than 1μ and 5 parts of titanium oxide powder having a particle size of not more than 25μ, were mixed. After thoroughly mixing them 2 parts of isopropyl alcohol and 1 part of cyclohexanol were added, and the mixture was kneaded to obtain a paste.

The paste was screen-printed to cover an area of 182×74.5 cm on one side of an exchange membrane having a size of 182×80.5 cm, composed of a copolymer of polytetrfluoroethylene and $CF_2{=}CFO(CF_2)_3COOCH_3$ and having anion exchange capacity of 1.43 meq/g dry resin and a thickness of 210μ, with use of an printing device comprising a stainless steel screen of 200 mesh having a thickness of 60μ and a screen mask provided thereunder and having a thickness of 8μ, and a polyurethane squeegee.

The printed layer formed on one side of the ion exchange membrane was dried in the air to solidify the paste.

In the same manner as above, titanium oxide having a particle size of not more than 25μ was screen-printed on the other side of the ion exchange membrane. Thereafter, the printed layer was pressed to the ion exchange membrane at a temperature of 140° C., under pressure of 30 kg/cm$^2$.

the titanium oxide layer formed on the ion exchange membrane had a thickness of 20μ, a porosity of 70% and a titanium oxide content of 1.5 mg/cm$^2$.

Thus, the porous layer was applied on the entire surface of the cation exchange membrane except for the edges having a length of 182 cm, along which a width of 3 cm was left uncoated.

Then, in the same manner as in Example 1, the side edges covered with the porous layer were joined to form a cylinder having the upper and lower ends uncoated with the porous layer in a width of 3 cm.

In the same manner as in Example 1, flares were formed and flanges were attached to the flares, and the flanged cylindrical cation exchange membranes were then mounted on the electrolytic cell. Then, electrolysis was conducted in the same manner as in Example 1.

The results thereby obtained are as follows:

NaOH concentrationi in the cathode compartment: 35% by weight

Cell voltage: 3.43 V $Cl_2$ concentration: 97.3%

NaCl concentration in the aqueous NaOH solution: 15 ppm

We claim:

1. In an electrolytic cell comprising intercalated finger-shaped electrodes each disposed through a cation exchange membrane, the improvement comprising that said cation exchange membrane constitutes a cylinder or envelope enclosing a finger-shaped anode or cathode which has a flare formed at one end or each end of the cylinder or at the open end of the envelope, said flare having a width of from 10 to 15 mm and being joined with a flange to form a unitary cation exchange membrane-flange structure with liquid-tightly divides an anode compartment from a cathode compartment of said cell.

2. The electrolytic cell according to claim 1 wherein a plurality of said unitary cation exchange membrane-flange structures are joined at their flanges with one another to form an integral assembly.

3. The electrolytic cell according to claim 1 wherein a plurality of said cylinders or envelopes are joined at their flares with a common flange sheet provided with a plurality of openings corresponding to said cylinders or envelopes, and the flares of the respective cylinders or envelopes are liquid-tightly sealed to the flange sheet along the edges of the respective openings.

4. The electrolytic cell according to claim 1, 2 or 3 wherein the cation exchange membrane is integrally provided at least on one side thereof with a gas and liquid permeable non-electrocatalytic porous layer having a thickness less than that of said cation exchange membrane.

5. The electrolytic cell according to claim 1 wherein the cylinder is formed by bending a rectangular cation exchange membrane to form a generally cylindrical shape with a small space left between the opposing side edges thereof, placing a thin resin film to cover the space and heat-sealing the resin film against said side edges.

6. The electrolytic cell according to claim 1 wherein the envelope is formed by bending a rectangular cation exchange membrane into a generally cylindrical shape with a small space left between the opposing side edges thereof, placing a thin resin film to cover the space, heat-sealing the resin film against said side edges to form a cylinder and closing one of the open ends of the cylinder.

7. The electrolytic cell according to claim 5 or 6 where in the heat-sealing width is at least twice said space and at least 2/3 of the width of said thin resin film.

8. The electrolytic cell according to claim 7 wherein the space is not more than 2 mm.

9. The electrolytic cell according to claim 1 wherein the flare is formed by placing against at least the inner surface of the cylinder or envelope of the cation exchange membrane, a deformable cylindrical body having a greater ridigity than the cation exchange membrane, and advancing a heated and tapered press die into the open end of the cylinder of the cation exchange membrane to outwardly stretch said open end.

* * * * *